US007014512B2

(12) United States Patent
Mase et al.

(10) Patent No.: US 7,014,512 B2
(45) Date of Patent: Mar. 21, 2006

(54) CONNECTOR AND A METHOD OF UNLOCKING A RETAINER THEREOF

(75) Inventors: Tsuyoshi Mase, Yokkaichi (JP); Tsutomu Tanaka, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/977,571

(22) Filed: Oct. 29, 2004

(65) Prior Publication Data

US 2005/0095923 A1 May 5, 2005

(30) Foreign Application Priority Data

Oct. 31, 2003 (JP) ..... 2003-372814

(51) Int. Cl.
*H01R 13/514* (2006.01)

(52) U.S. Cl. ..... 439/752

(58) Field of Classification Search ..... 439/752, 439/595

See application file for complete search history.

(56) References Cited

U.S. PATENT DOCUMENTS 6,139,375 A * 10/2000 Konoya et al. ..... 439/752
6,193,551 B1 * 2/2001 Yamamoto et al. ..... 439/595
6,443,781 B1 * 9/2002 Kubo ..... 439/752
6,527,579 B1 3/2003 Sato et al.
6,648,699 B1 * 11/2003 Makino et al. ..... 439/752
6,692,302 B1 * 2/2004 Tsuji et al. ..... 439/595
6,769,934 B1 * 8/2004 Nakamura et al. ..... 439/595
6,872,093 B1 * 3/2005 Fukatsu et al. ..... 439/595

* cited by examiner

*Primary Examiner*—Gary Paumen
(74) *Attorney, Agent, or Firm*—Gerald E. Hespos; Anthony J. Casella

(57) ABSTRACT

A connector (10) has a retainer (12) assembled into a housing (11), a catch (D1) of a disengaging jig (D) is inserted into a jig-inserting portion (17) in the retainer (12) to unlock the retainer (12) at a full locking position by the principle of the lever. A support (18) projects out on the housing (11) and serves as a fulcrum of the disengaging jig (D). A distance between the jig inserting portion (17) of the retainer (12) as a point of action and the supporting portion (18) as the fulcrum can be made long. Thus, upon unlocking the retainer (12) using the disengaging jig (D), the retainer (12) can be lifted up to a position where the retainer (12) can be sufficiently unlocked and a load acting at the point of action becomes larger to facilitate unlocking even if an inclining amount of the disengaging jig (D) is small.

11 Claims, 13 Drawing Sheets

CONNECTOR AND A METHOD OF UNLOCKING A RETAINER THEREOF

BACKGROUND OF THE INVENTION

1. Field of the Invention

The present invention relates to a connector with a retainer and to a method of unlocking a retainer thereof.

2. Description of the Related Art

U.S. Pat. No. 6,527,579 and FIG. 13 herein disclose a connector with a retainer. With reference to FIG. 13, the connector 1 has a housing 2 and a retainer 3. The retainer 3 fits into a retainer-accommodating portion 4 that opens in a side surface of the housing 2 and directly locks terminal fittings. The outer surface of the fitted retainer 3 is flush with the side surface of the housing 2 so that a mating housing 5 or other member does not catch the retainer 3. The retainer 3 is engaged securely in the housing 2, and a disengaging jig is used to disengage the retainer 3. More particularly, the leading end of the disengaging jig is engaged with the retainer 3. A portion of the disengaging jig spaced from the leading end then is pivoted against an opening edge of the retainer accommodating portion 4 to lift and disengage the retainer 3. Thus, the disengaging jig functions as a lever and the opening edge of the retainer accommodating portion 4 functions as a fulcrum.

A distance between the opening edge of the retainer accommodating portion 4, as a fulcrum, and the leading end of the disengaging jig, as a point of action, is considerably shorter than a distance between a portion of the disengaging jig gripped by an operator (point of force application) and the opening edge of the retainer accommodating portion 4 (fulcrum). Thus, the retainer 3 cannot be lifted to a position where the retainer 3 can be disengaged unless the gripped portion of the disengaging jig is inclined significantly. Therefore, a sufficient operation range may not be ensured if an obstacle is present in the inclining direction of the disengaging jig, thereby making it difficult to disengage the retainer 3.

The invention was developed in view of the above problem and an object thereof is to facilitate disengagement of a retainer by a disengaging jig.

SUMMARY OF THE INVENTION

The invention relates to a connector with a housing that has a retainer accommodating portion in a side surface thereof. At least one terminal fitting is insertable into and withdrawable from the housing and a retainer is fittable into the retainer accommodating portion to lock the terminal fitting. A jig inserting opening is formed between an opening edge of the retainer accommodating portion and the retainer. A lever action then is effected with the leading end of a disengaging jig inserted in the jig inserting opening, thereby enabling the retainer to be moved with respect to the retainer accommodating portion away from the terminal fitting. A support is provided on the outer surface of the housing and projects farther out than the outer surface of the properly mounted retainer. The support serves as a fulcrum for the lever action of the disengaging jig.

The support enables a longer distance between the retainer, as the point of action, and the support, as the fulcrum in the lever action of the disengaging jig. As a result, even if an angle of inclination of the disengaging jig is small, an amount of movement of the front end of the disengaging jig is sufficient to disengage the retainer. Therefore, the retainer can be disengaged easily using the disengaging jig.

The outer surface of the properly mounted retainer preferably is substantially flush with the outer surface of the housing around the retainer accommodating portion.

A preventing portion preferably is provided on the outer surface of the housing at a side of the support substantially opposite from the retainer. The disengaging jig is dimensioned to contact the preventing portion after the disengaging jig has unlocked the retainer and to prevent any further inclining movement of the disengaging jig. Thus, an excessive inclining movement of the disengaging jig is prevented, and the retainer will not be lifted excessively.

The retainer preferably is movable between a partial locking position where the terminal fittings can be inserted and withdrawn and a full locking position where the retainer locks the terminal fittings. The full locking position is reached by moving the retainer towards the outer surface of the housing.

The preventing portion preferably contacts the disengaging jig to prevent further inclining movement of the disengaging jig after the retainer has been moved from the full locking position to the partial locking position. Thus, there is no possibility that the disengaging jig will urge the retainer completely out of the housing.

The support preferably projects at least as far as the outer surface of the retainer when the retainer is at the partial locking position. Thus, the support substantially prevents external matter from interfering with the retainer, and prevents the retainer from being pushed inadvertently to the full locking position.

The housing preferably comprises a terminal-accommodating portion for accommodating the terminal fittings. A receptacle is provided before the terminal accommodating portion and is configured for receiving a mating housing. The retainer preferably is mounted into the terminal accommodating portion and the support preferably is on the terminal-accommodating portion.

The receptacle preferably projects out from the terminal-accommodating portion and a portion of the receptacle adjacent the terminal-accommodating portion preferably defines the preventing portion. Thus, the shape of the housing is simplified as compared to a case where a preventing portion for exclusive use is formed.

The support preferably bulges out at a position along an inserting direction of the terminal fitting into the cavity at a part of the outer surface of the housing before the retainer-accommodating portion to form a lock defining space that communicates with the cavity. A resiliently deformable lock is provided in the lock forming space and is engageable with the terminal fitting. By forming the lock inside the outwardly bulging support, it is not necessary to provide a separate space for forming the lock, thereby enabling the miniaturization of the housing.

A protrusion preferably is provided on the housing on a side of the retainer-accommodating portion substantially opposite to the support. The protrusion preferably projects out to at least the same height as the support.

A guiding surface preferably is provided at the support and near the retainer-accommodating portion to guide the jig into the jig inserting portion.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 1:
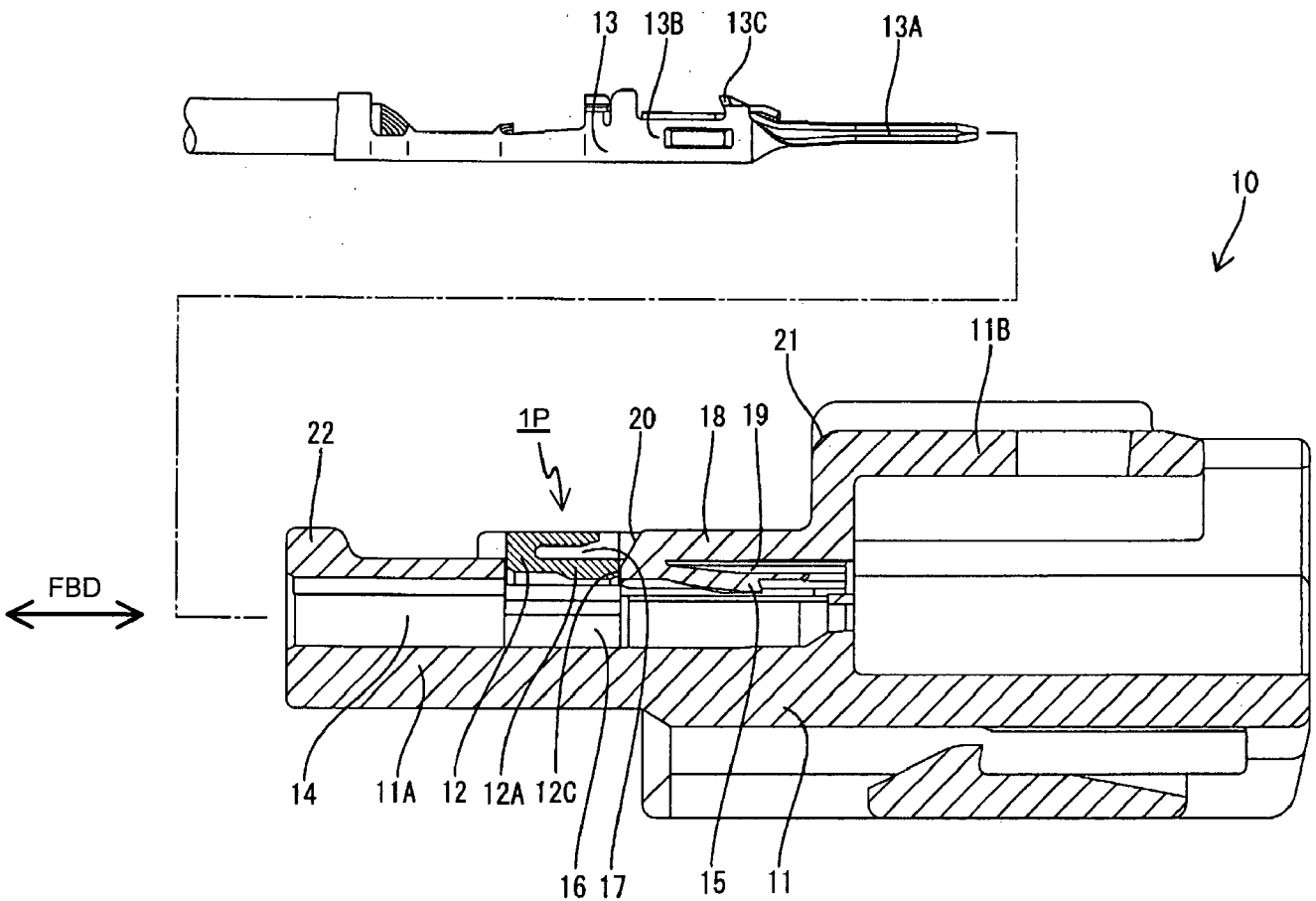
FIG. 1 is a section of a connector having a retainer mounted at a partial locking position.
Figure 2:
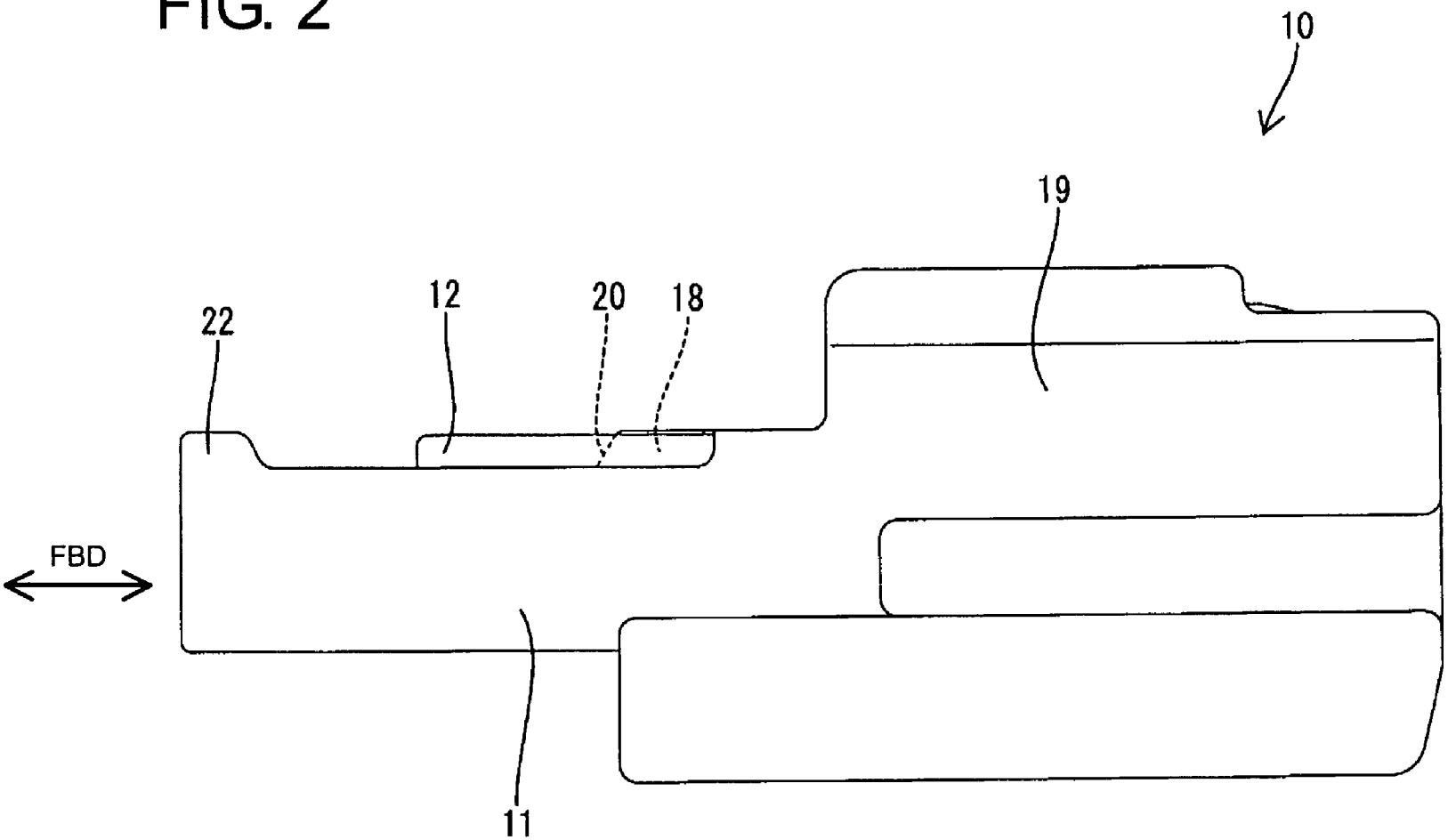
FIG. 2 is a side view of the connector having the retainer mounted at the partial locking position.

A connector according to the invention is identified by the numeral 10 in FIGS. 1 to 12. As shown in FIG. 1, the connector 10 has a housing 11 with a terminal accommodating portion 11A for accommodating male terminal fittings 13. The housing 11 also has a receptacle 11B that is larger than the terminal accommodating portion 11A. The receptacle 11B is located before the terminal accommodating portion 13A and is configured to receive a mating housing (not shown).

Cavities 14 extend forward into the terminal accommodating portion 11A from the rear end surface of the housing 11 and the terminal fittings 13 are inserted into the cavities from behind. The terminal fitting 13 has a tab 13A that projects into the receptacle 11B when the terminal fitting 13 is accommodated in the cavity 14 (see FIG. 6).

A retainer-accommodating portion 16 is formed in an intermediate part of an outer surface of the terminal accommodating portion 11A with respect to forward and backward directions FBD and opens up substantially normal to the forward and backward directions FBD. The retainer-accommodating portion 16 includes a locking space 16A that communicates with intermediate parts of the cavities 14 with respect to forward and backward directions. Guiding grooves 16B are formed at opposite widthwise sides of the locking space 16A and extend along the forward and backward directions FBD (see FIG. 3).

A substantially bridge-shaped retainer 12 is insertable into the retainer-accommodating portion 16 for locking the terminal fittings 13 in the cavities 14. The retainer 12 has a terminal lock 12A to be accommodated in the locking space 16A and housing locks 12B to be inserted into the respective guiding grooves 16B. The housing locks 12B are engageable with the housing 11 at a partial locking position 1P (position of FIG. 1) and at a full locking position 2P (position of FIG. 6). The terminal lock 12A is provided with locking projections 12C for contacting the corresponding terminal fittings 13. More particularly, the locking projections 12C are retracted to positions to permit the insertion and withdrawal of the terminal fittings 13 (see FIG. 1) when the retainer 12 is located at the partial locking position 1P. However, the locking projections 12C enter the cavities 14 to engage rear end edges of box portions 13B of the terminal fittings 13 when the retainer 12 is at the full locking position 2P (see FIG. 6).

Figure 9:
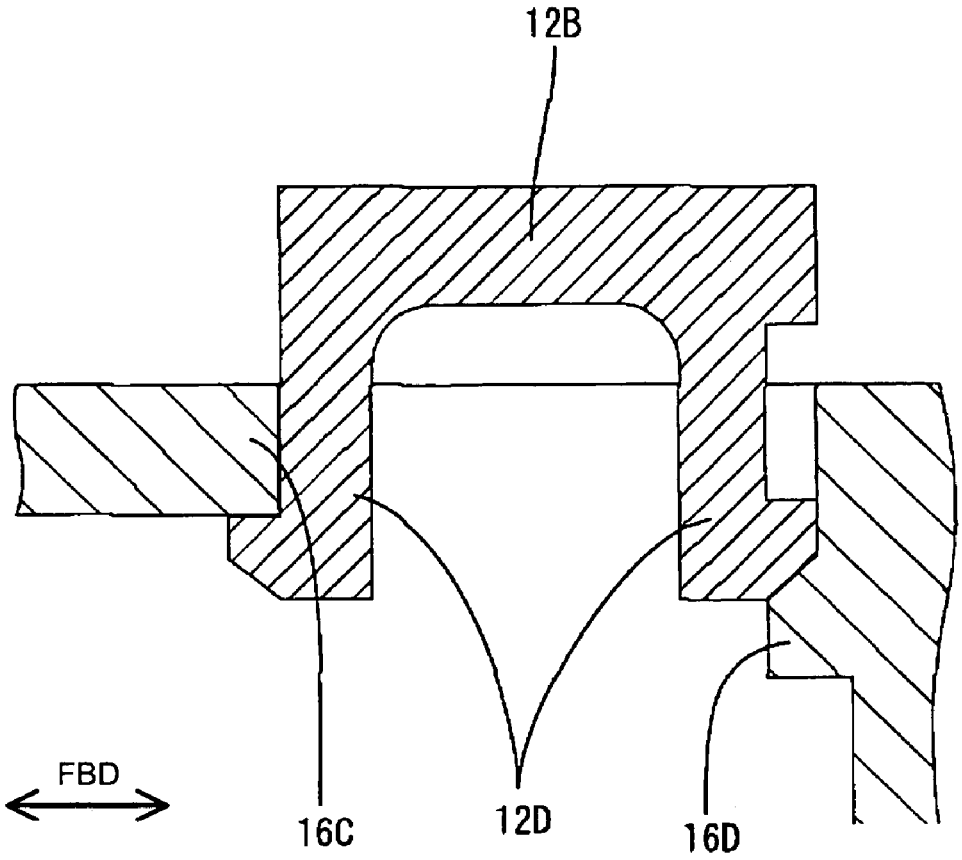
FIG. 9 is a partial enlarged section showing a housing locking portion of the retainer at the partial locking position.
Figure 10:
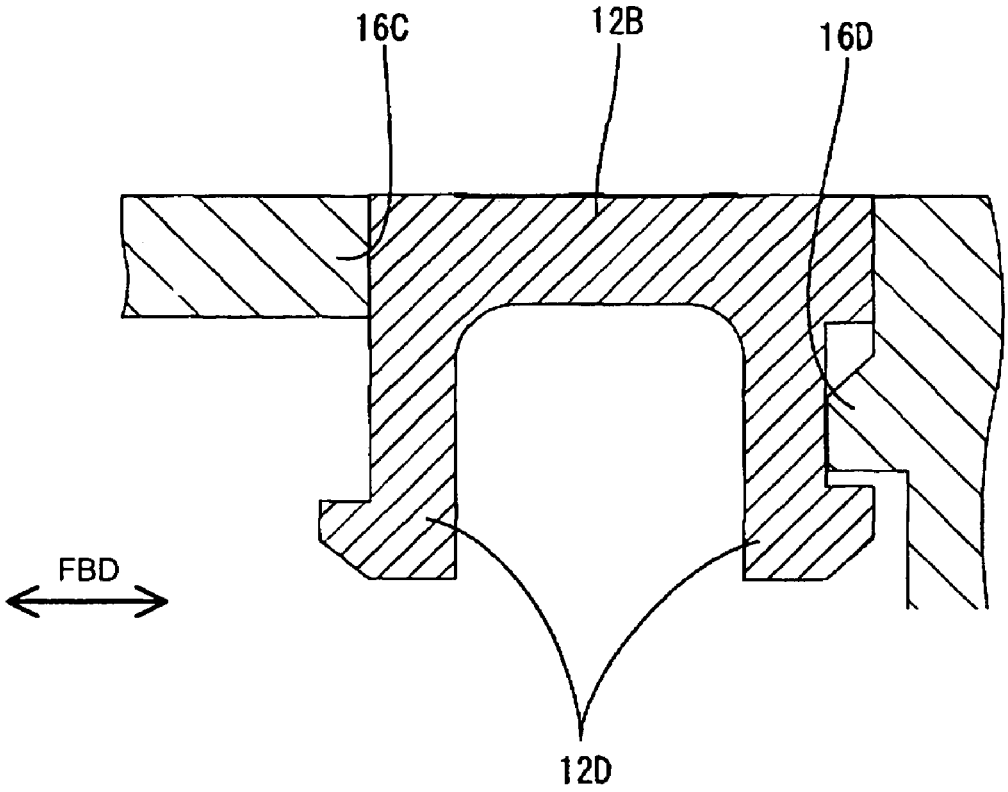
FIG. 10 is a partial enlarged section showing the housing locking portion of the retainer at the full locking position.

As shown in FIGS. 9 and 10, each housing lock 12B has two legs 12D that deform resiliently towards each other. On the other hand, locking steps 16C, 16D are formed on the wall surfaces of each guiding groove 16 that face each other substantially along forward and backward directions FBD at positions corresponding to the legs 12D. One leg 12D is engaged with the corresponding locking step 16C when the retainer 12 is at the partial locking position 1P, whereas this leg piece 12D is disengaged from the locking step 16C and the other leg piece 12D is engaged with the corresponding locking step 16D when the retainer 12 is moved to the full locking position 2P.

The retainer 12 is formed to be substantially flush with the outer surface of the housing 11 behind the retainer-accommodating portion 16 when the retainer 12 is fully locked at the second position 2P.

Figure 3:
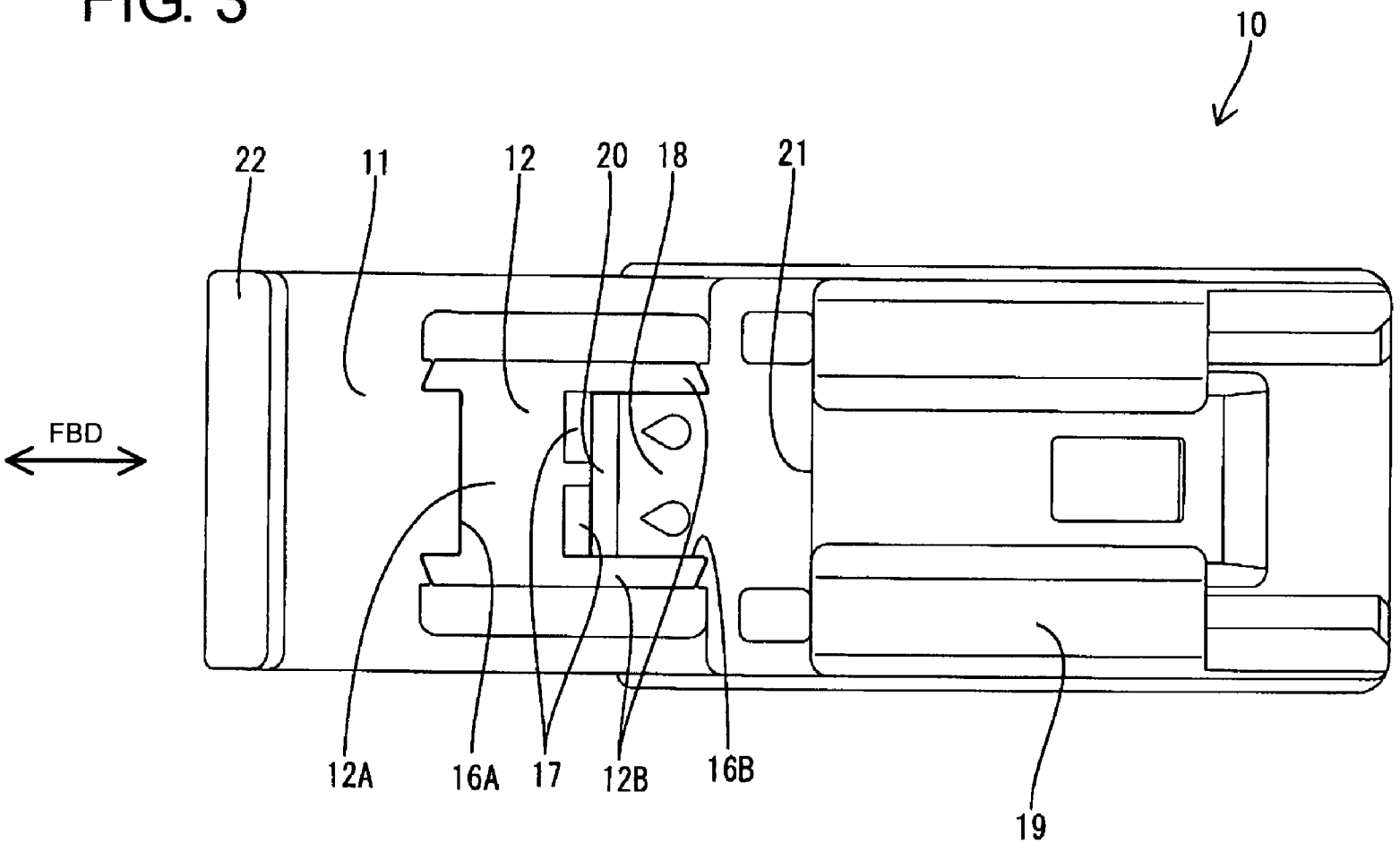
FIG. 3 is a plan view of the connector having the retainer mounted at the partial locking position.
Figure 4:
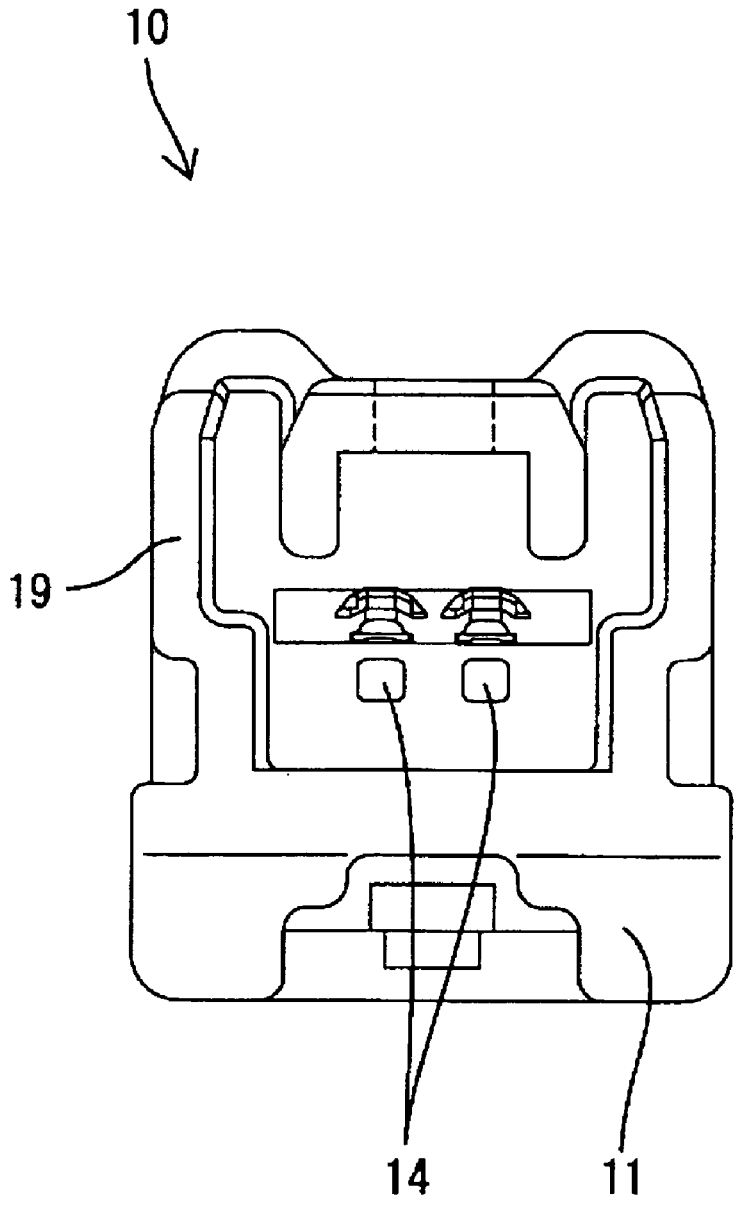
FIG. 4 is a front view of the connector having the retainer mounted at the partial locking position.
Figure 5:
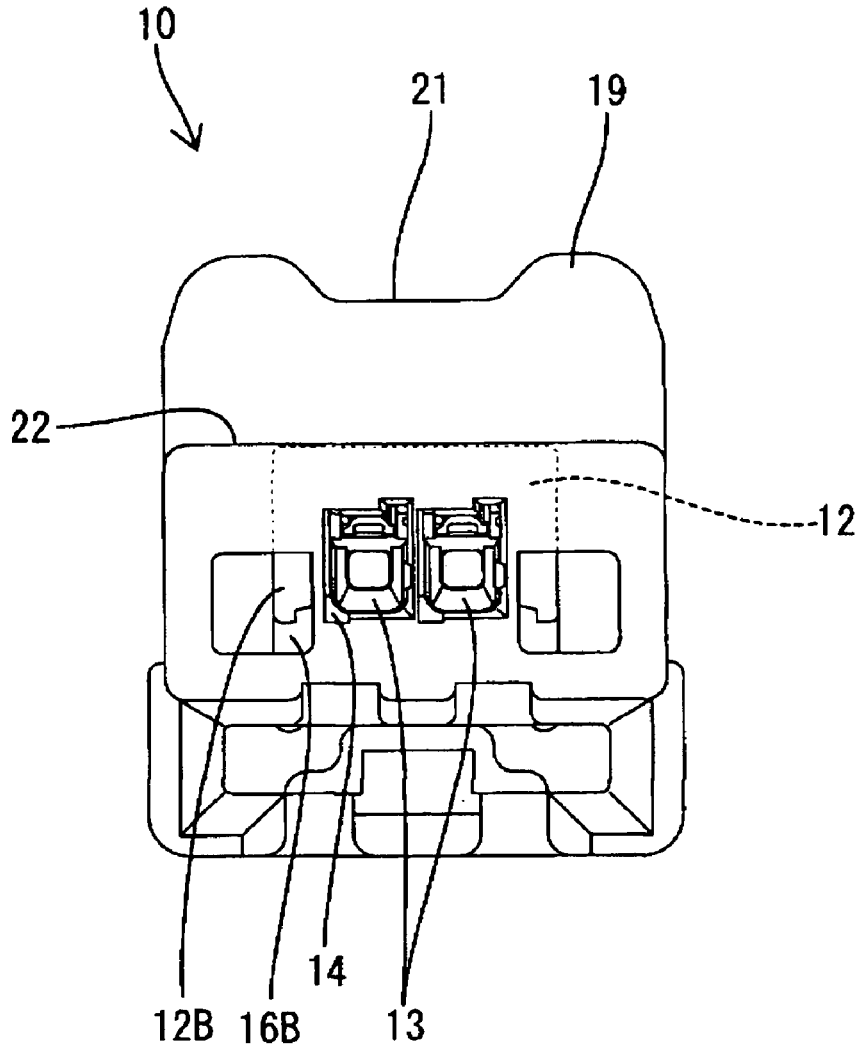
FIG. 5 is a rear view of the connector having the retainer mounted at the partial locking position.
Figure 6:
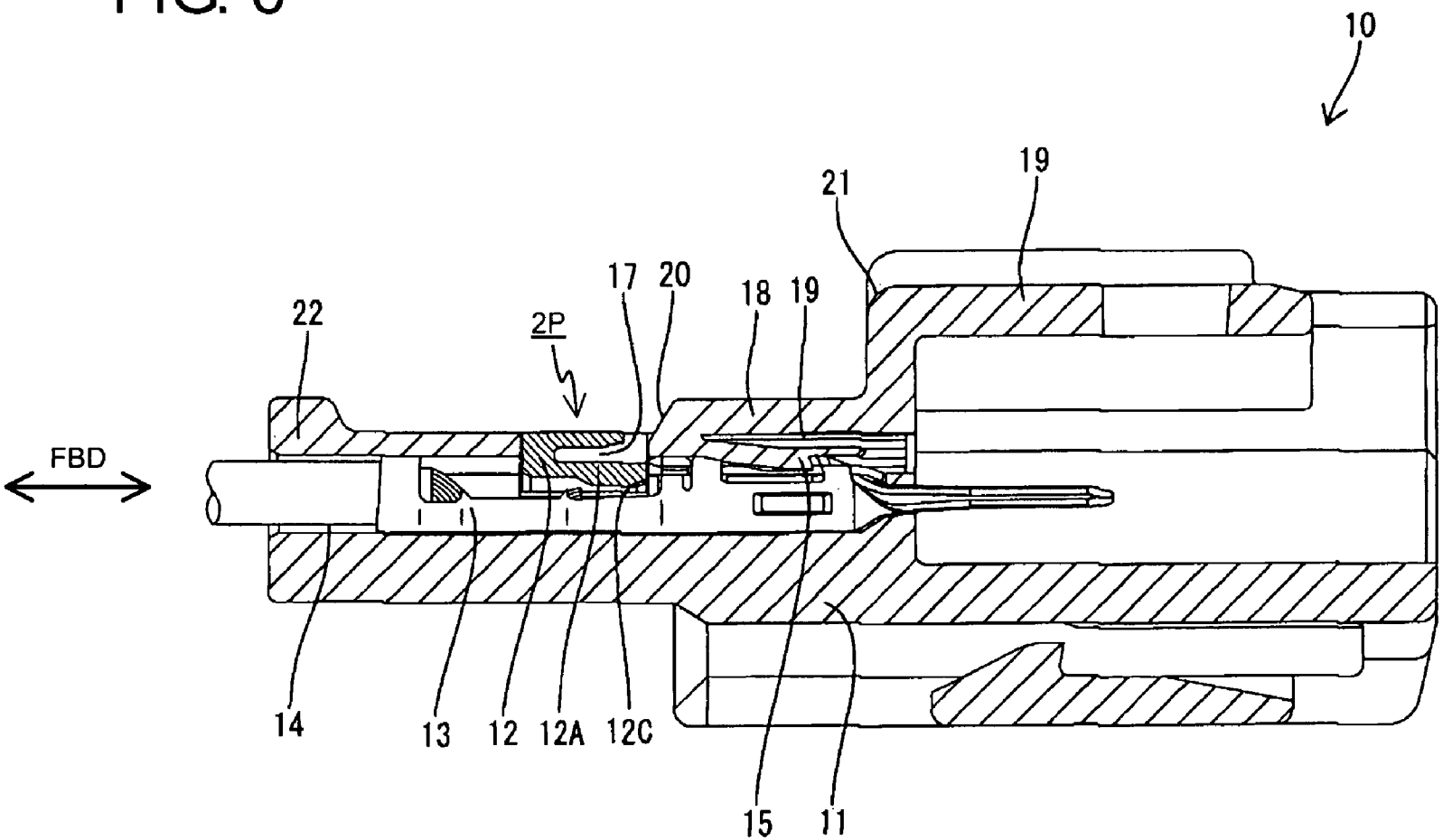
FIG. 6 is a section of the connector having the retainer mounted at a full locking position.
Figure 7:
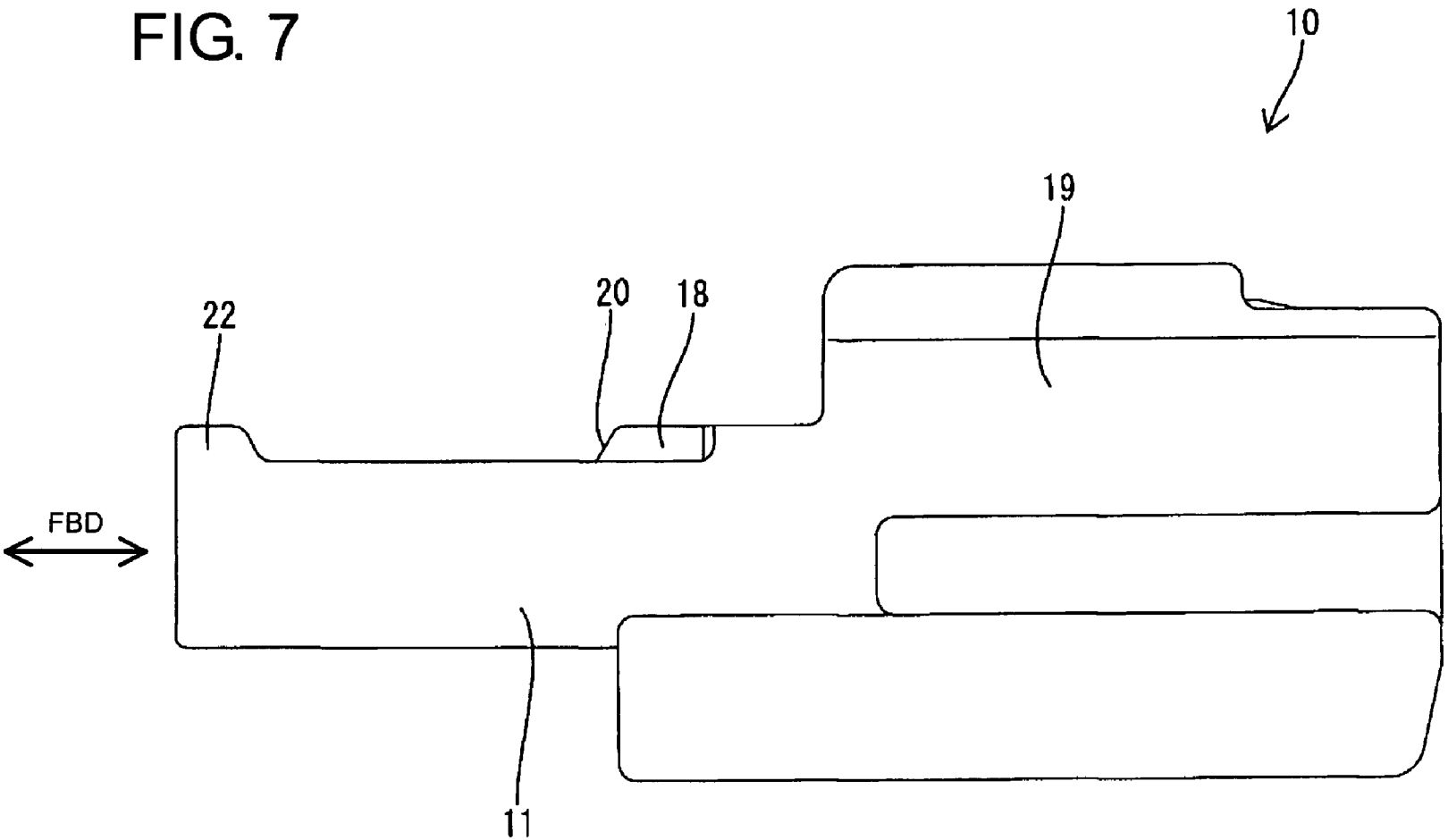
FIG. 7 is a side view of the connector having the retainer mounted at the full locking position.
Figure 8:
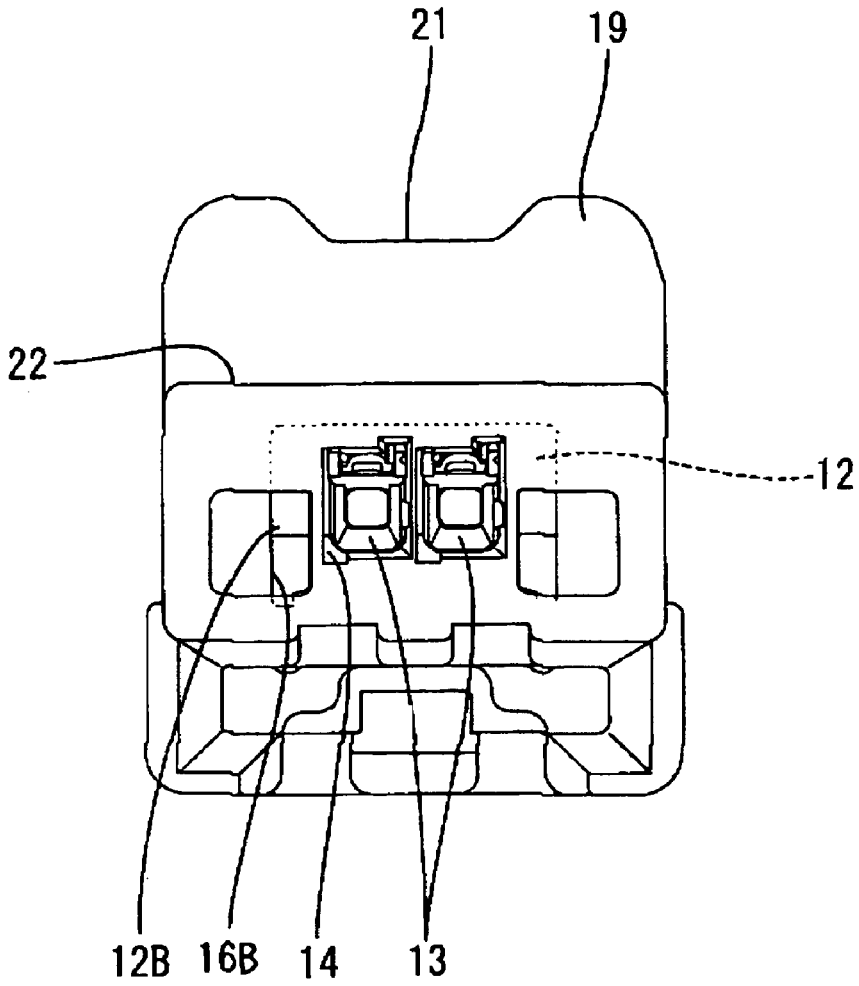
FIG. 8 is a rear view of the connector having the retainer mounted at the full locking position.

As shown in FIGS. 1 and 3, two jig-inserting portions 17 are formed in a widthwise middle portion of the terminal locking portion 12A of the retainer 12 by recessing. Each jig-inserting portion 17 includes a vertical hole portion extending in a depth direction and a horizontal hole portion substantially continuous with the vertical hole portion and extending substantially parallel to forward and backward directions FBD (see FIG. 1).

Figure 11:
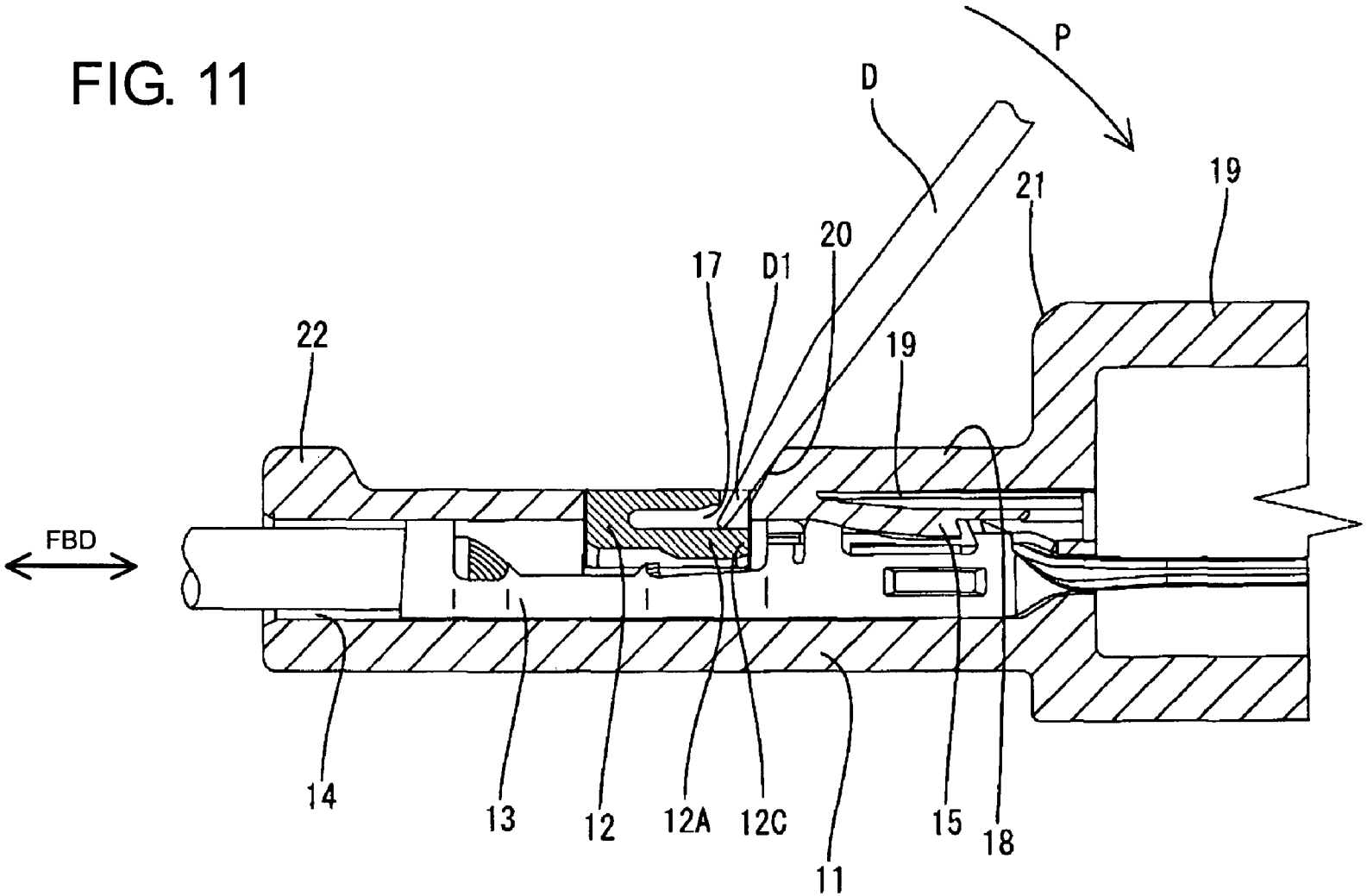
FIG. 11 is a section showing a state where a disengaging jig is placed on the retainer at the full locking position.
Figure 12:
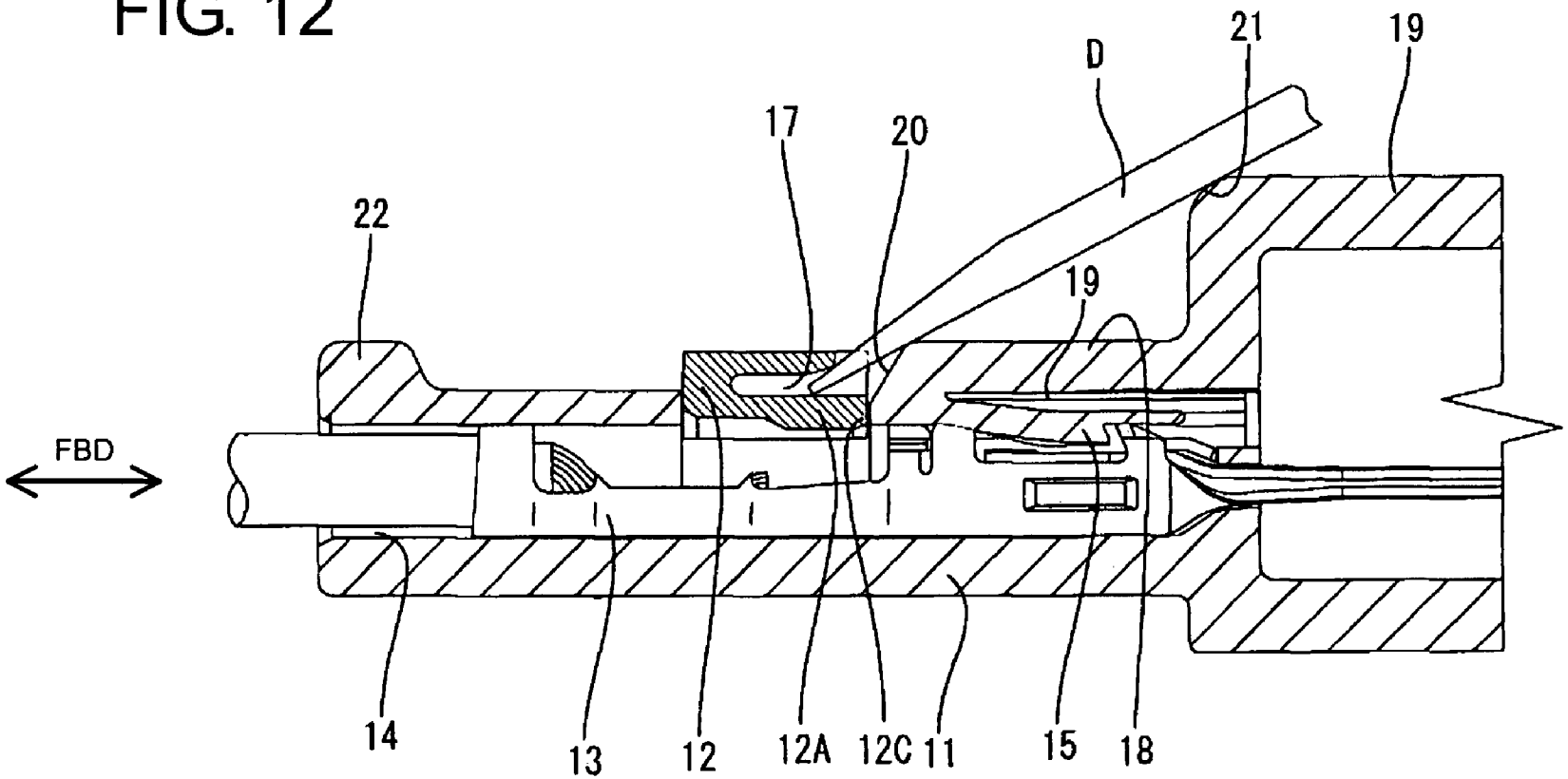
FIG. 12 is a section showing a state where the retainer is unlocked to reach the partial locking position.
Figure 13:
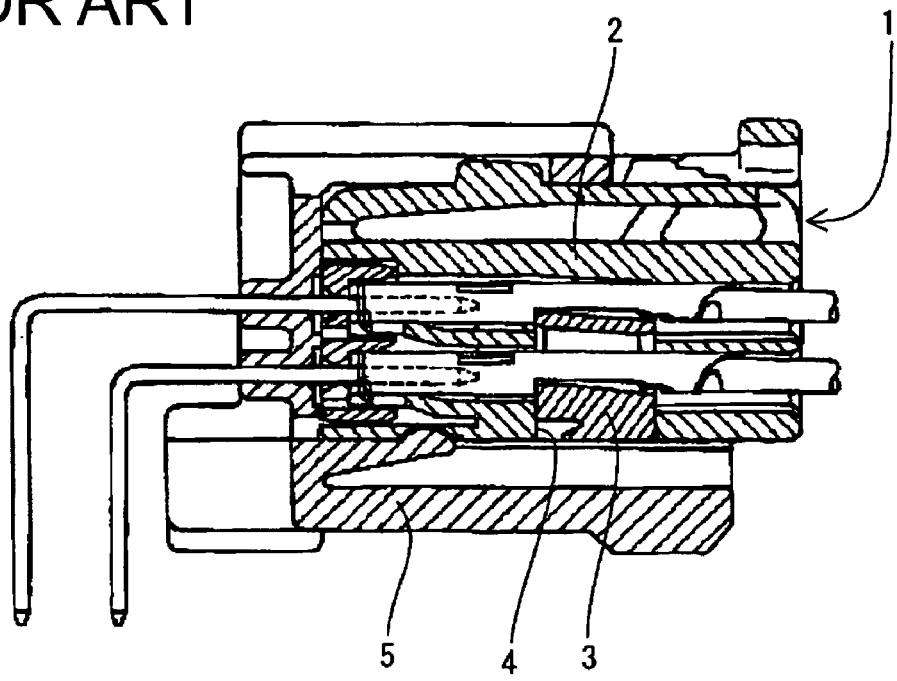
FIG. 13 PRIOR ART
FIG. 13 is a section of a prior art connector.

On the other hand, a disengaging jig D is substantially bar-shaped like a screw driver and includes a substantially tapered catch D1 that is thinned gradually towards the leading end, as shown in FIG. 11 or 12. The catch D1 can engage a wall surface of the retainer 12 at a boundary between the vertical hole portion and the horizontal hole portion.

A support 18 bulges out from the outer surface of the terminal accommodating portion 12A at a mounting side of the retainer 12 between the retainer accommodating portion 16 and the receptacle 11B. The housing 11 has an increased thickness in a portion corresponding to the support 18 as compared to other portions, such as the receptacle 11B or other parts of the terminal accommodating portion 11A. A part of the support 18 near the receptacle 11B extends over substantially the entire width of the housing, as shown in FIG. 3. However, a narrowed portion is formed near the retainer-accommodating portion 16. The narrowed portion enters between the two housing locks 12B of the retainer 12 and substantially faces the terminal lock 12A. A slanted surface 20 slopes down toward the jig inserting portions 17 and the retainer-accommodating portion 16 at the rear end of the narrowed portion and near the retainer accommodating portion 16. Thus, the disengaging jig D is caused to slide down substantially along the slanted surface 20, thereby guiding the insertion of the disengaging jig J into the jig inserting portion 17.

The disengaging jig D is pivoted in a direction of arrow P towards the receptacle 11B while the leading end of the disengaging jig J is the jig inserting portion 17, as shown in FIG. 11. Thus, a lever action is effected with the leading end of the disengaging jig D as a point of action and the upper edge of the slanted surface 20 as a fulcrum. Accordingly, the retainer 12 is moved from the full locking position 2P to the partial locking position 1P.

A stepped excessive operation preventing surface 21 is defined at the connection of the receptacle 11B with the support 18 and is contacted by the disengagement jig J in the process of the lever action. The retainer 12 is lifted substantially to the height of the first position 1P when the disengaging jig D contacts the excessive operation preventing surface 21.

The outer surface of the support 18 is slightly higher than the upper surface of the retainer 12 at the partial locking position 1P. Thus, contact of external matter with the retainer 12 at the partial locking position 1P is unlikely. Further, a protrusion 22 is provided on the outer surface of the rear end of the housing 11 on the same side as the support 18 and projects out to substantially the same height as the support 18. Since the retainer 12 at the partial locking position 1P is between the support 18 and the protrusion 22. Thus, contact of external matter with the retainer 12 is less likely.

Further, areas of the cavities 14 corresponding to the support 18 are extended in the height direction by causing the support 18 to bulge out. In this embodiment, these extended areas serve as locking-portion forming areas 19, and locks 15 are provided substantially along forward and backward directions FBD at least partly in the spaces 19. Each lock 15 is resiliently deformable along a height direction, which is substantially normal to the forward and backward directions FBD, and is engageable with a locking projection 13C projecting from the box 13B of the terminal fitting 13.

The retainer 12 at the full locking position 2P in the connector 10 can be unlocked by inserting the leading end and the catch D1 of the disengaging jig D into the jig inserting portion 17, as shown in FIG. 11. A portion of the disengaging jig D farther from the leading end than the catch D1 is placed on the rear end of the support 18. The substantially flat slanted surface 20 extends obliquely towards the opening of the jig inserting portion 17 in the connector 10. Thus, the disengaging jig D can be guided along the substantially flat slanted surface 20.

The disengaging jig D then is pivoted in the direction of arrow P shown in FIG. 11 by manually operating the grip (not shown) of the disengaging jig D. An outward or upward-acting force is exerted on the catch D1 by the principle of the lever, and this force lifts up the retainer 12. Then, the one leg 12D shown in FIG. 10 is disengaged from the corresponding locking step 16D and the retainer 12 is moved up and out.

The disengaging jig D contacts the excessive operation preventing portion 21, as shown in FIG. 12, to prevent further movement of the jig D and to limit lifting movement of the retainer 12. The operation preventing portion 21 stops the retainer 12 at the partial locking position 1P so that an operator can guide the retainer 12 to the partial locking position 1P without paying any particular attention. In this way, the disengagement of the retainer 12 from the full locking position 2P is completed.

A distance between the jig inserting portion 17 of the retainer 12, as a point of action, and the support 18, as a fulcrum, defines a lever length and can be made long as compared to the prior art by providing the support 18 bulging out of the housing 11. Thus, the retainer 12 can be lifted to the unlocked position with a larger load at the point of action to facilitate the unlocking even if an inclining amount of the disengaging jig D is small as compared to the prior art.

The disengaging jig D contacts the excessive operation preventing portion 21 when the retainer 12 reaches the partial locking position 1P to prevent further pivotal movement of the disengaging jig D. Therefore, there is no possibility that the retainer 12 is lifted inadvertently beyond the partial locking position 1P and into a position where the retainer 12 could come out of the housing 11.

The disengaging jig D is guided into the jig inserting portion 17 along the slanted surface 20. Thus, an inserting operation of the disengaging jig D is easier.

The locks 15 are in the lock forming spaces 19 that are formed during formation of the support 18 that bulges outward of the housing 11. Thus, it is not necessary to provide separate spaces for the locks 15, and the housing 11 can be miniaturized.

The support 18 has a substantially flat surface in an area between the receptacle 11B and the retainer accommodating portion 16. Conceivably, the support 18 could project locally along an edge near the retainer accommodating portion 16. However, such a local projection is likely to be damaged by an external force, but there is no such possibility of damage with the support 18 described above.

The retainer 12 at the partial locking position 1P is protected between the support 18 and the protruded portion 22. Thus, external matter is unlikely to contact the retainer 12 and inadvertently push the retainer 12 to the full locking position 2P.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the support 18 is provided adjacent to the insertion opening of the retainer-accommodating portion 16 in the foregoing embodiment, it may be at a position forward from this position.

Only a part of the support 18 that serves as the fulcrum for the lever action may project from the outer surface of the housing 11.

The support 18 may be formed at a position higher or lower than the upper surface of the retainer 12 at the partial locking or first position 1P.

The excessive operation-preventing portion 21 is formed on the receptacle 11B in the foregoing embodiment. However, the excessive operation-preventing portion 21 may be formed separately from the receptacle 11B. Further, the excessive operation-preventing portion 21 may be formed on a connector 10 having no receptacle 11B.

What is claimed is:

1. A connector, comprising:

a housing having a side surface and a retainer accommodating portion formed in the side surface;

at least one terminal fitting insertable into and withdrawable from the housing;

a retainer fittable into the retainer accommodating portion and movable between a partially mounted state and a properly mounted state to lock the terminal fitting(s);

a disengaging-jig inserting opening formed between an opening edge of the retainer accommodating portion and the retainer; and a support provided on the outer surface of the housing substantially adjacent the disengaging-jig inserting opening and projecting out beyond the retainer when the retainer is in the properly mounted state, the support being disposed to define a fulcrum for a lever action effected by inserting a leading end of a disengaging jig in the disengaging-jig inserting portion and pivoting the disengaging jig against the support for moving the retainer from the properly mounted state to the partially mounted state.

2. The connector of claim 1, wherein the retainer has an outer surface that is substantially flush with the outer surface of the housing adjacent the retainer accommodating portion when the retainer is in the properly mounted state.

3. The connector of claim 1, further comprising a preventing portion on the outer surface of the housing at a side of the support substantially opposite from the retainer, the preventing portion being disposed and dimensioned for contacting the disengaging jig after the retainer is released from the fully mounted state and preventing further inclining movement of the disengaging jig.

4. The connector of claim 3, wherein the retainer is configured to permit insertion and withdrawal of the terminal fittings when the retainer is in the partially mounted state.

5. The connector of claim 4, wherein the preventing portion is disposed and configured for contacting the disengaging jig when the retainer reaches the partially mounted state.

6. The connector of claim 5, wherein the support is arranged at least at substantially the same height as an outer surface of the retainer at the partially mounted position.

7. The connector of claim 3, wherein:

the housing comprises a terminal accommodating portion for accommodating the terminal fitting(s), and a receptacle that bulges more outward than the terminal accommodating portion, the receptacle being configured for receiving a mating housing; and the retainer is mounted into the terminal accommodating portion, the support being on the terminal accommodating portion.

8. The connector of claim 7, wherein the preventing portion is formed on an outer edge of the receptacle at a portion forming a step to the terminal accommodating portion.

9. The connector of claim 1, wherein the support bulges out at a position along an inserting direction of the terminal fitting and at a part of an outer surface of the housing before the retainer accommodating portion, thereby defining a lock defining space, and a resiliently deformable lock in the lock forming space and engageable with the terminal fitting.

10. The connector of claim 1, wherein a protrusion is provided on the housing an a side of the retainer accommodating portion substantially opposite to the support, the protrusion projecting out to a height substantially as high as the support.

11. The connector of claim 1, wherein a guiding surface is provided at the support and near the retainer accommodating portion to guide the jig into the jig inserting portion.

* * * * *